United States Patent [19]

Kubiak

[11] Patent Number: 4,700,807

[45] Date of Patent: Oct. 20, 1987

[54] TREE STEP

[75] Inventor: Robert E. Kubiak, Robbinsville, N.J.

[73] Assignee: Foxcraft, Inc., Robbinsville, N.J.

[21] Appl. No.: 900,288

[22] Filed: Aug. 25, 1986

[51] Int. Cl.[4] ..... A63B 27/00; A63B 29/04

[52] U.S. Cl. ..... 182/92; 182/189

[58] Field of Search ..... 182/92, 91, 90, 100, 182/189, 87; 248/225.1, 223.4

[56] References Cited

U.S. PATENT DOCUMENTS

| | | | |
|---|---|---|---|
| 1,588,566 | 6/1926 | Wismer | 248/223.4 |
| 2,762,595 | 9/1956 | Jenne | 248/225.1 |
| 3,380,697 | 4/1968 | Melcher | 182/92 |
| 3,498,409 | 3/1970 | Meyer | 182/92 |
| 4,413,706 | 11/1983 | Michael | 182/92 |
| 4,415,061 | 11/1983 | Meyer | 182/92 |

FOREIGN PATENT DOCUMENTS

| | | | |
|---|---|---|---|
| 1016563 | 1/1966 | United Kingdom | 248/223.4 |

*Primary Examiner*—Reinaldo P. Machado

*Attorney, Agent, or Firm*—Richard C. Woodbridge

[57] ABSTRACT

A tree step includes a means for driving an anchor screw into a tree and then removing the step from the anchor screw. The step comprises an L-shaped bracket having a horizontal foot support section and a vertical screw engaging section associated therewith. An outwardly facing channel having a square cross-sectional profile is incorporated into the vertical screw driving section. The square head of the screw is slipped into the open end of the channel which is located near the intersection of the horizontal and vertical sections and then advanced to the closed end of the channel. Rotation of the horizontal foot support section causes the screw to advance into the tree. Once the screw has advanced as far as posible, the step may then be used to support human weight. After use, the step can be slipped off of the anchor screw thereby leaving it in the tree for subsequent reuse. Alternatively, the step can be rotated in the reverse direction thereby backing the screw out so that it can be used on another tree.

5 Claims, 13 Drawing Figures

16
10
34
44
36
14
48
26
18
12

TREE STEP

BACKGROUND OF THE INVENTION

1. Field of the Invention

The invention relates to a tree step having a detachable anchor screw.

2. Description of Related Art

Tree steps are employed by hunters and outdoorsmen for the purpose of creating a temporary foothold on a tree. A number of prior art tree steps use an anchor screw that is permanently attached to the step itself. See, e.g., U.S. Pats. Nos. 3,380,697 and 4,413,706 which describe tree steps in which the anchor screw is permanently attached to a portable step. An alternative method is described in U.S. Pat. No. 4,415,061 in which the anchor screw is separable from the tree step.

Another type of related tree step is illustrated in FIGS. 1 and 2. The structure of the tree steps illustrated in FIGS. 1 and 2 are identical except for the fact that the embodiment in FIG. 1 has a hinge so that it can be folded against itself. Unfortunately, such structures have several drawbacks. First, the structure is believed to be moderately difficult to produce because it requires that a punch form a keyhole shaped aperture in the front of the vertical portion. Second, in order to place the wood screw into the driving position the operator has to perform two motions. The first motion is to insert the head through the aperture and the second motion is to slip the shank into the narrow portion of the keyhole opening. If the tree step is jammed against the bark of a tree it is difficult to remove the tree step given the two directions that the head of the wood screw has to move. Third, because the structure disclosed in FIGS. 1 and 2 faces inward it has the tendency to accumulate rain and moisture thereby causing rust and eventual deterioration of the unit. The present invention does not experience the shortcomings described with reference to prior art FIGS. 1 and 2.

SUMMARY OF THE INVENTION

Briefly described the invention comprises a tree step apparatus including means to permit the user to separate the step from the anchor screw after the anchor screw has been engaged in a tree. The step comprises an L-shaped bracket having a horizontal foot support section and a vertical screw engaging section associated therewith. An outwardly facing channel having a square cross-sectional profile is located on the outside face of the horizontal and vertical sections. The channel portion on the vertical section includes inwardly facing lips or ridges. The square head of a screw is slipped into the channel near the intersection of the vertical and horizontal sections and then advanced to the closed end of the channel which is furthest from the intersection of the vertical and horizontal sections. Rotating the horizontal foot section clockwise causes the screw to advance into a tree. Once the screw is advanced as far as possible, the step may then be used to support human weight. After use, the step can be slipped off of the anchor screw thereby leaving it in the tree for subsequent reuse. Alternatively, the steps can be rotated in the reverse counterclockwise direction thereby backing the screw out so that it can be used on another tree.

The tree step is especially easy to use. The head of the screw can be engaged by the channel in the vertical section with one single motion, namely by simply sliding the head into the channel. Similarly, the tree step can be disengaged from the anchor screw by applying motion in only one direction. The construction of the tree step is especially economical and efficient. The step itself basically comprises an outwardly facing channel in which the vertical section has keeper lips and a closed end to prevent the head of the anchor screw from disengaging. Facing the channel outward prevents water from collecting in the interior of the channel thereby discouraging rust and corrosion. The ability to easily reuse anchor screws at other locations improves the overall economy of the device to the sportsman.

These and other features of the present invention will be more fully understood by reference to the following drawings.

DETAILED DESCRIPTION OF THE INVENTION

Figure 1:
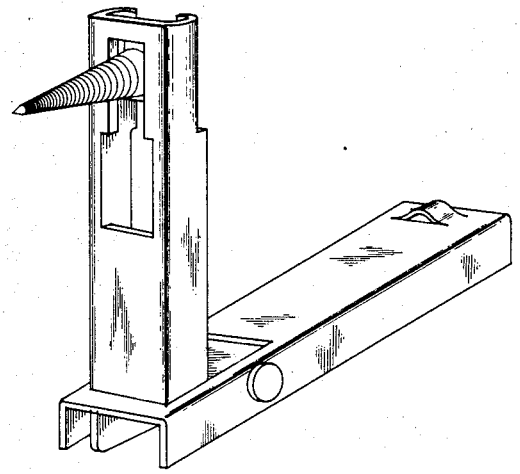
FIG. 1 (PRIOR ART)
FIG. 1 is a perspective view of a prior art tree step.

During the course of this description like numbers will be used to identify like elements according to the different views which illustrate the invention.

The preferred embodiment of the invention 10 is illustrated in detail in FIGS. 3 through 7. The tree step 10 essentially comprises a wood screw 12 and a handle 14. Handle 14 includes a vertical screw driving section 18 connected to a horizontal foot support section 16 at a right angle bend 34. The material of the tree step 10 preferably comprises a lightweight aluminum or stainless steel extrusion having a substantially U-shaped cross-section. The outwardly U-shaped channel is bent at location 34 thereby forming the horizontal section 16 and the vertical section 18 respectively. The vertical portion of the channel 20 extends up inside vertical screw drive section 16 and ends abruptly at the top 22. Vertical section 18 is further defined by a back surface 24, which is connected at right angles to right and left sidewalls 26 and 28 respectively. Right and left lips 30 and 32 are attached to right and left sidewalls 26 and 28 in the manner illustrated in FIG. 4B. Lips 30 and 32 are attached at right angles to sidewalls 26 and 28 so as to form a partially rectangular channel as illustrated in detail in FIG. 6.

Horizontal foot support section 16 includes a slightly turned up end 36 and non-skid checkering 44 which helps prevent the foot of the user 50 from slipping off of the horizontal foot support section 16.

Each wood screw 12 includes a square head 38, a shank portion 40 and a threaded section 42. The flights on screws 12 are structured to bite firmly into tree 48 and provide a good dependable anchor for the step 14. The minimum distance between the inwardly facing lips 30 and 32 is smaller than the minimum width of screw head 38 but larger than the diameter of shank 40 so that the wood screw 12 does not slip out of channel 20 when engaged in the manner shown in FIGS. 5, 6 and 7. The length of each edge of square head 38 is just slightly less than the distance between oppositely faced sidewalls 26 and 28 so that head 38 is captured in channel 20 in a snuggly slidable fashion. Channel 20 is accessible through opening entrance 46 which is located near bend 34. It is relatively easy to slip the head 38 into the entrance opening 46 and then up channel 20 so that it comes to rest against the channel stop 22.

Figure 8A:
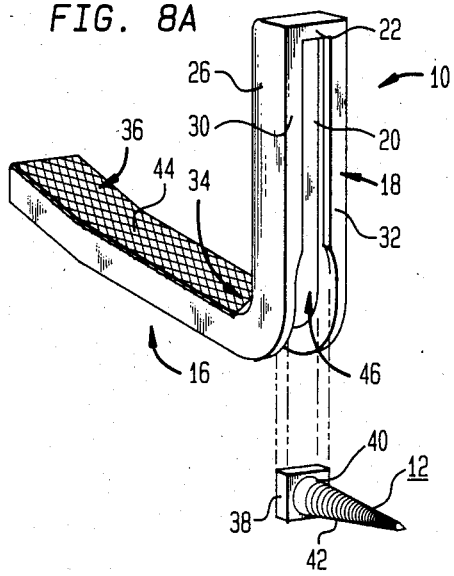
FIGS. 8A through 8E illustrate the steps of the method for attaching the tree step to a tree and for removing same.
Figure 8B:
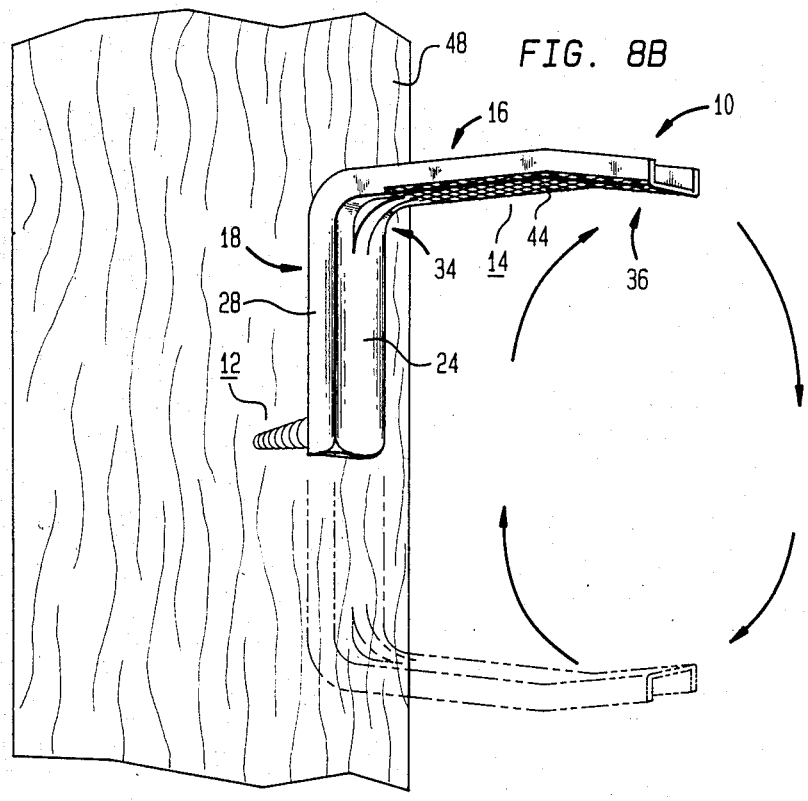

The tree step 10 according to the preferred embodiment of the invention is attached to a tree in the manner illustrated in FIGS. 8A and 8B. Initially a wood screw 12 is inserted into channel 20 in the manner illustrated in FIG. 8A. The square head 38 slips easily into entrance opening 46 and up channel 20 until it comes to rest against the stop 22. Only one motion in one direction is necessary to place the wood screw 12 in the operating position illustrated in FIG. 7.

The second step, illustrated in FIG. 8B comprises screwing the wood screw 12 into a tree 48. Typically some pressure is applied by the left hand against the back surface 24 in order to initiate the augering process. The right hand of the user, presuming the user is right handed, then rotates the horizontal foot support section 16 in a clockwise manner illustrated by the direction of the arrows in FIG. 8B. Rotation of the handle section 14 causes the screw 12 to penetrate the tree to a depth primarily determined by the length of the screw 12.

Figure 8C:
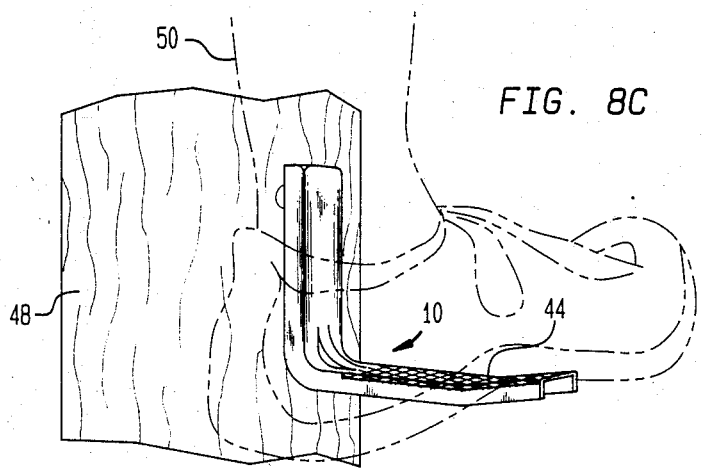

Third, once the screw 12 has penetrated tree 48 to a sufficient depth it may then be used as a step. Screw 12 is preferably not screwed in so deep that the vertical section 18 is jammed against the tree 48. The tree step 10 illustrated in FIG. 8C is now sufficiently anchored to support the weight of the foot of a climber 50.

Figure 8D:
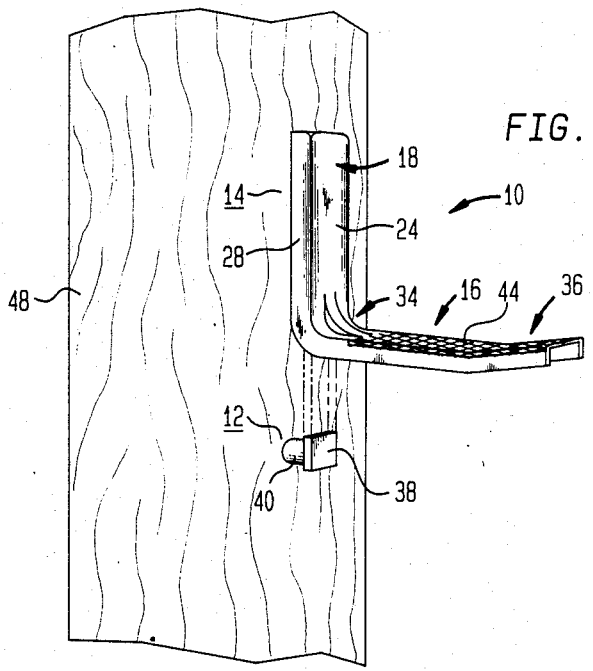

A fourth step, if desired, is illustrated in FIG. 8D. The fourth step comprises removing the handle 14 from the wood screw 12 by slipping the square head 38 out of channel 20 through opening 46. In that manner the wood screw 12 may be left in tree 48 and then subsequently reused on a later occasion. This represents a significant improvement over many other prior art tree steps in which the screw was permanently attached to the handle thereby necessitating the removal of the entire tree step.

Figure 8E:
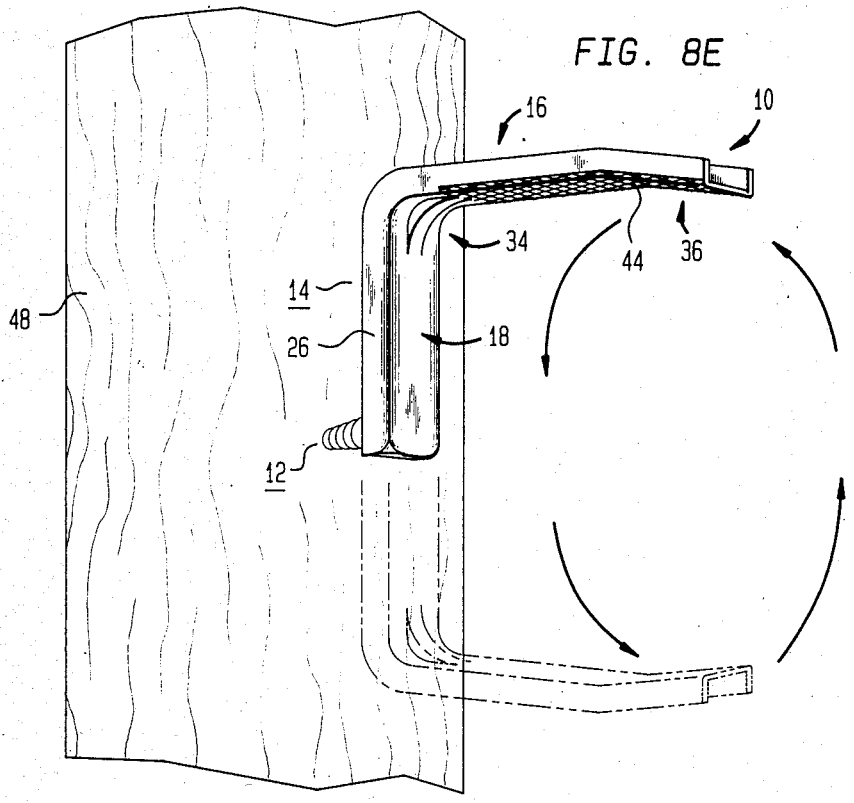

Lastly, the screw 12 may be removed by employing the fifth step illustrated in FIG. 8E. In order to remove the screw 12 it is first necessary to re-engage it in the manner shown in FIGS. 3 through 7. Then the handle assembly 14 is rotated in the counterclockwise direction causing the screw 12 to advance out of the tree 48. The screw 12 and handle 14 may then be reused on another tree.

Figure 2:
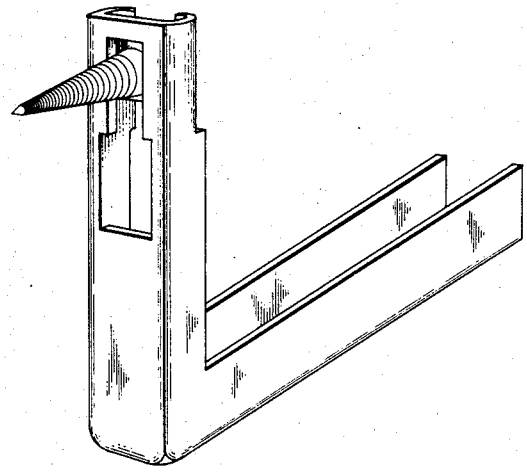
FIG. 2 (PRIOR ART)
FIG. 2 is a perspective view of another prior art tree step.
Figure 3:
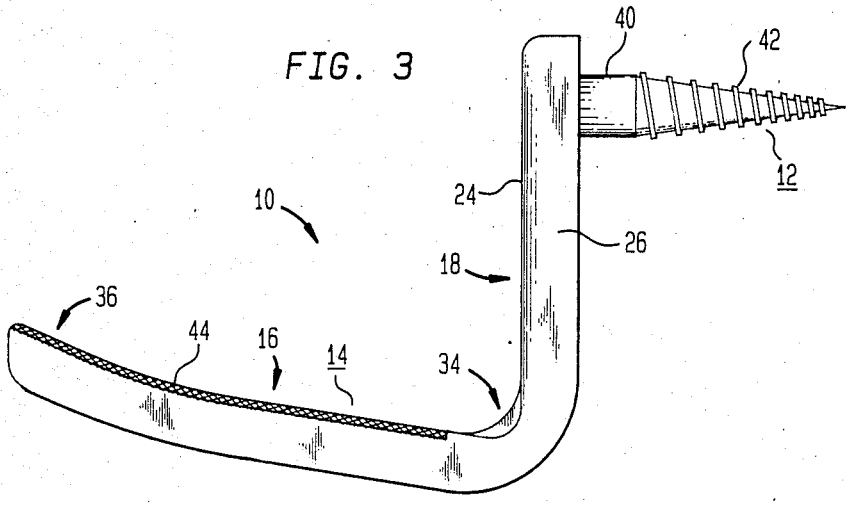
FIG. 3 is a side elevational view of the preferred embodiment of the present tree step invention.
Figure 4A:
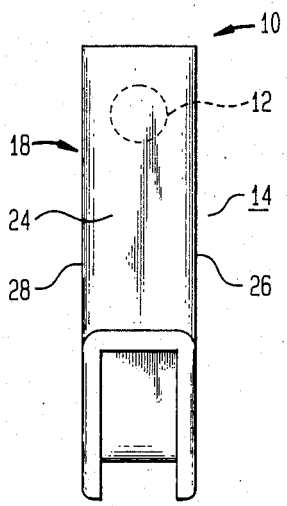
FIG. 4A is a rear elevational view of the preferred embodiment illustrated in FIG. 3.
Figure 4B:
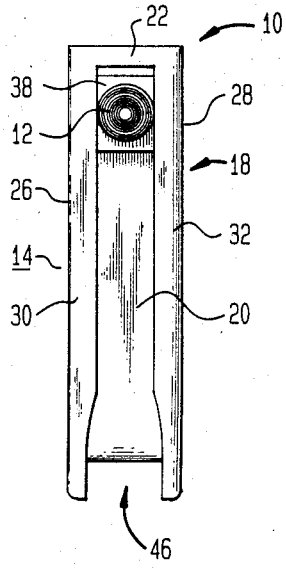
FIG. 4B is a front elevational view of the preferred embodiment illustrated in FIG. 3.
Figure 5:
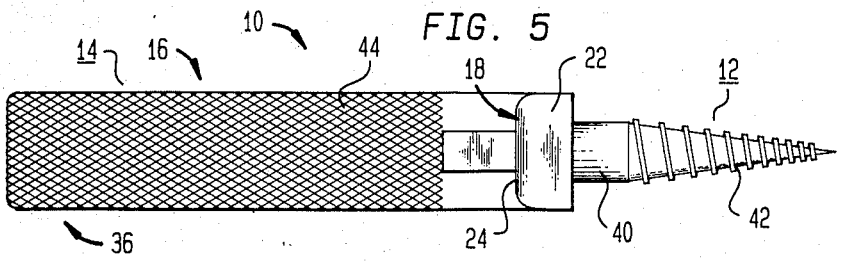
FIG. 5 is a top plan view of the preferred embodiment illustrated in FIG. 3.
Figure 6:
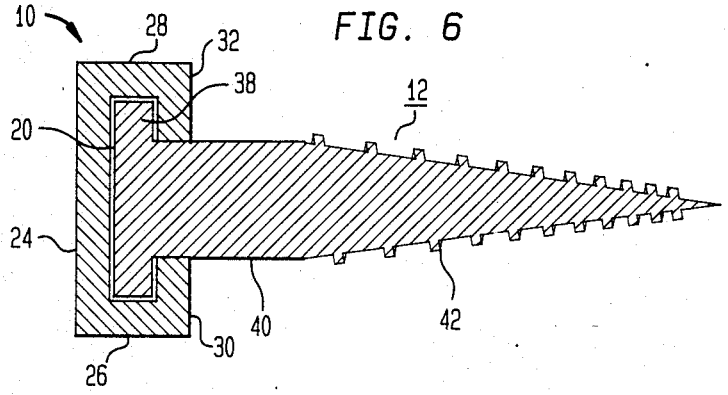
FIG. 6 is a horizontal cross-sectional view of the wood screw shown engaged in the channel.
Figure 7:
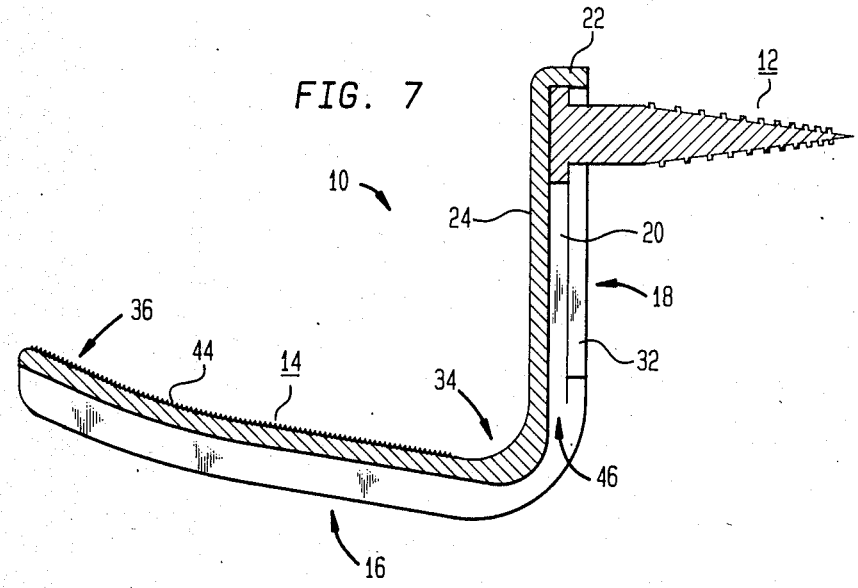
FIG. 7 is a vertical cross-sectional view of the preferred embodiment of the tree step.

The foregoing invention has several advantages over the prior art. First, it only takes one motion to place the screw 12 in the operative position as shown in cross-section in FIG. 7. Second, because the channel 20 faces outward, it is impossible for moisture to collect on the inside of the handle assembly 14. This is in contrast to prior art units such as as those illustrated in FIGS. 1 and 2 where moisture can accumulate on the inside causing rust and eventual deterioration of the tree step. Third, the present invention 10 is relatively economical to manufacture. The entire handle portion can be formed from a single continuous piece of outwardly facing channel which is subsequently machined to required specifications. Fourth, substantial economies can be realized by making the wood screw 12 separable from the handle 14. This permits the user to leave only the wood screw 12 in a tree 48, rather than having to leave the entire tree step itself attached to a tree.

While the invention has been described with reference to the preferred embodiment thereof, it will be appreciated by those of ordinary skill in the art that various modifications can be made to the structure and function of the invention without departing from the spirit and scope thereof.

I claim:

1. A tree step apparatus for use with a screw having a head portion and a shank portion having screw flights therein for screwing into a tree, said apparatus comprising:

a horizontal foot support section;

a vertical screw engaging section attached to said horizontal foot support section; and, substantially continuous channel means for detachably engaging said screw, said channel means facing outward in the direction of said screw and including an open end and a closed end, said open end being located near the intersection of said horizontal foot support section and said vertical screw engaging section, said channel means including:

(a) a back section that extends substantially the length of said horizontal foot support section and said vertical screw engaging section;

(b) first and second sidewall sections connected to said back section and substantially vertical with respect to the plane of said back section, said first and second sidewall sections also extending substantially the length of said horizontal foot support section and said vertical screw engaging section; and, (c) first and second keeper lip sections substantially parallel to the plane of said back section and attached respectively to said first and second sidewall sections and facing inwardly therefrom and extending at least substantially the length of said vertical screw engaging section, said first and second keeper lip sections defining a slot having a width narrower than the width of the head portion of said screw but wider than the shank of said screw, wherein said screw may be held by said vertical screw engaging section by sliding said screw into said channel means in a straight continuous motion and then subsequently screwing said screw into a tree using the horizontal foot support section as a handle and wherein said screw may be removed from said channel means by sliding said screw out of said channel means in another straight continuous motion.

2. The apparatus of claim 1 wherein said horizontal foot support section includes a slightly up-turned portion located at the end of said horizontal foot support section furtherest removed from the intersection of said horizontal and vertical sections.

3. The apparatus of claim 2 wherein the head portion of said screw has a substantially square cross-sectional shape.

4. The apparatus of claim 3 wherein said horizontal foot support section includes a non-slip checkered surface.

5. The apparatus of claim 4 wherein said horizontal foot support section and said vertical screw engaging section are formed from a continuous piece of bent metal material.

* * * * *